US005721576A

United States Patent [19]

Barinaga

[11] Patent Number: 5,721,576

[45] Date of Patent: Feb. 24, 1998

[54] REFILL KIT AND METHOD FOR REFILLING AN INK SUPPLY FOR AN INK-JET PRINTER

[75] Inventor: John Barinaga, Corvallis, Oreg.

[73] Assignee: Hewlett-Packard Company, Palo Alto, Calif.

[21] Appl. No.: 566,641

[22] Filed: Dec. 4, 1995

[51] Int. Cl.[6] ..... B41J 2/175; B65B 1/04

[52] U.S. Cl. ..... 347/85; 141/329

[58] Field of Search ..... 347/84–87; 222/206, 222/215; 141/2, 18, 326, 329

[56] References Cited

U.S. PATENT DOCUMENTS

| | | | |
|---|---|---|---|
| 2,888,173 | 5/1959 | Wolcott | 222/183 |
| 4,831,389 | 5/1989 | Chan | 347/86 |
| 4,959,667 | 9/1990 | Kaplinsky | 347/87 |
| 4,967,207 | 10/1990 | Ruder | 347/7 |
| 5,199,470 | 4/1993 | Goldman | 141/1 |
| 5,280,300 | 1/1994 | Fong | 347/87 |
| 5,283,593 | 2/1994 | Wehl | 347/86 |
| 5,307,091 | 4/1994 | DeCoste, Jr. | 347/86 |
| 5,328,055 | 7/1994 | Battle | 222/83.5 |
| 5,329,294 | 7/1994 | Ontawar | 347/87 |
| 5,369,429 | 11/1994 | Erickson | 347/7 |
| 5,396,268 | 3/1995 | Mader | 347/7 |
| 5,400,573 | 3/1995 | Crystal | 53/468 |
| 5,408,256 | 4/1995 | Keen | 347/87 |

FOREIGN PATENT DOCUMENTS

| | | | |
|---|---|---|---|
| 0640484A2 | 8/1994 | European Pat. Off. | B41J 2/175 |
| 0672527A2 | 8/1994 | European Pat. Off. | B41J 2/175 |
| 0685339A2 | 5/1995 | European Pat. Off. | B41J 2/175 |

OTHER PUBLICATIONS

Greene et al.; "Constant –Pressure Head Ink Supply";IBM Technical Disclosure Bulletin; vol. 15 No. 9; Feb. 1973.

*Primary Examiner*—John E. Barlow, Jr.
*Assistant Examiner*—Judy Nguyen
*Attorney, Agent, or Firm*—Kevin B. Sullivan

[57] ABSTRACT

A refill kit is provided with a variable volume refill reservoir for containing a quantity of ink and a hollow needle in fluid communication with the reservoir. To refill an ink supply, the hollow needle is inserted through a port in the ink supply and the variable volume refill reservoir is compressed to urge the ink within the refill kit into the ink supply. A septum within the port seals the port when the needle is withdrawn.

2 Claims, 11 Drawing Sheets

118
130
44
52
32
37
208
204
202
200
54
26
58
66
34
64
56
60
82
78
70
68
62
84
36
104
102
112
106
28
100
99
108
20

REFILL KIT AND METHOD FOR REFILLING AN INK SUPPLY FOR AN INK-JET PRINTER

BACKGROUND OF THE INVENTION

1. Field of the Invention

The present invention relates to a kit for refilling an ink supply for an ink-jet printer and to a method of using the kit to refill an ink supply.

2. Description of Related Art

A typical ink-jet printer has a print head mounted to a carriage which is moved back and forth over a printing surface, such as a piece of paper. As the print head passes over appropriate locations on the printing surface, a control system activates ink jets on the print head to eject, or jet, ink drops onto the printing surface and form desired images and characters.

To work properly, such printers must have a reliable supply of ink for the print head. Many ink-jet printers use a disposable ink pen that can be mounted to the carriage. Such an ink pen typically includes, in addition to the print head, a reservoir containing a supply of ink. The ink pen also typically includes pressure regulating mechanisms to maintain the ink supply at an appropriate pressure for use by the print head. When the ink supply is exhausted, the ink pen is disposed of and a new ink pen is installed. This system provides an easy, user friendly way of providing an ink supply for an ink-jet printer.

Other types of ink-jet printers use ink supplies that are separate from the print head and are not mounted to the carriage. Such ink supplies, because they are stationary within the printer, are not subject to all of the size limitations of an ink supply that is moved with the carriage. Some printers with stationary ink supplies have a refillable ink reservoir built into the printer. Ink is supplied from the reservoir to the print head through a tube which trails from the print head. Alternatively, the print head can include a small ink reservoir that is periodically replenished by moving the print head to a filling station at the stationary, built-in reservoir. In either alternative, ink may be supplied from the reservoir to the print head by either a pump within the printer or by gravity flow.

Still other ink-jet printers use replaceable reservoirs that are separate from the print head. These reservoirs, like the built-in reservoirs are not located on the carriage and, thus, are not moved with the print head during printing. Replaceable reservoirs are often plastic bags filled with ink. The bag is provided with a mechanism, such as a septum which can be punctured by a hollow needle, for coupling it to the printer so that ink may flow from the bag to the print head. Often, the bag is squeezed, or pressurized in some other manner, to cause the ink to flow from the reservoir.

Once depleted, the reservoir is typically discarded and a new reservoir installed. However, the reservoir and any associated mechanisms are typically capable of further use if they could be replenished with a fresh supply of ink.

SUMMARY OF THE INVENTION

Accordingly, it is an object of the present invention to provide an ink supply, a refill kit and a method for refilling an ink supply for an ink-jet printer to reliably provide a supply of ink for a print head.

It is a further object of the invention to provide a refill kit and method of refilling an ink supply which is not complicated and which can be simply and inexpensively manufactured and easily used.

It is a further object of the invention to provide a refill kit and a method of refilling an ink supply for an ink-jet printer that is cost-effective, environmentally friendly, limits waste and more efficiently uses components of the ink supply.

An ink supply for refilling in accordance with one aspect of the present invention has a main reservoir for holding a supply of ink. The main reservoir can be coupled to a pump to supply ink from the reservoir to the printer. The pump may include a variable volume chamber and a check valve such that when the volume of the chamber is increased, ink is drawn from the reservoir through the valve and into the chamber. When the volume of the chamber is decreased ink is forced from the chamber to supply the print head.

In one aspect of the invention, the reservoir includes a port through which ink can be introduced into the reservoir. The port is blocked by a septum that can be pierced to allow refilling of the reservoir.

In another aspect of the invention, a refill kit is provided for refilling the reservoir. The refill kit includes a variable volume refill reservoir, such as a bellows, for containing a quantity of ink to be introduced into the chamber. A hollow needle is coupled to the refill reservoir. In this manner, a user can pierce the septum with the needle and compress the refill reservoir to force ink from the refill kit and into the ink supply. When the needle is withdrawn, the septum reseals the reservoir.

Other objects and aspects of the invention will become apparent to those skilled in the art from the detailed description of the invention which is presented by way of example and not as a limitation of the present invention.

DESCRIPTION OF THE ILLUSTRATED EMBODIMENT

Figure 1:
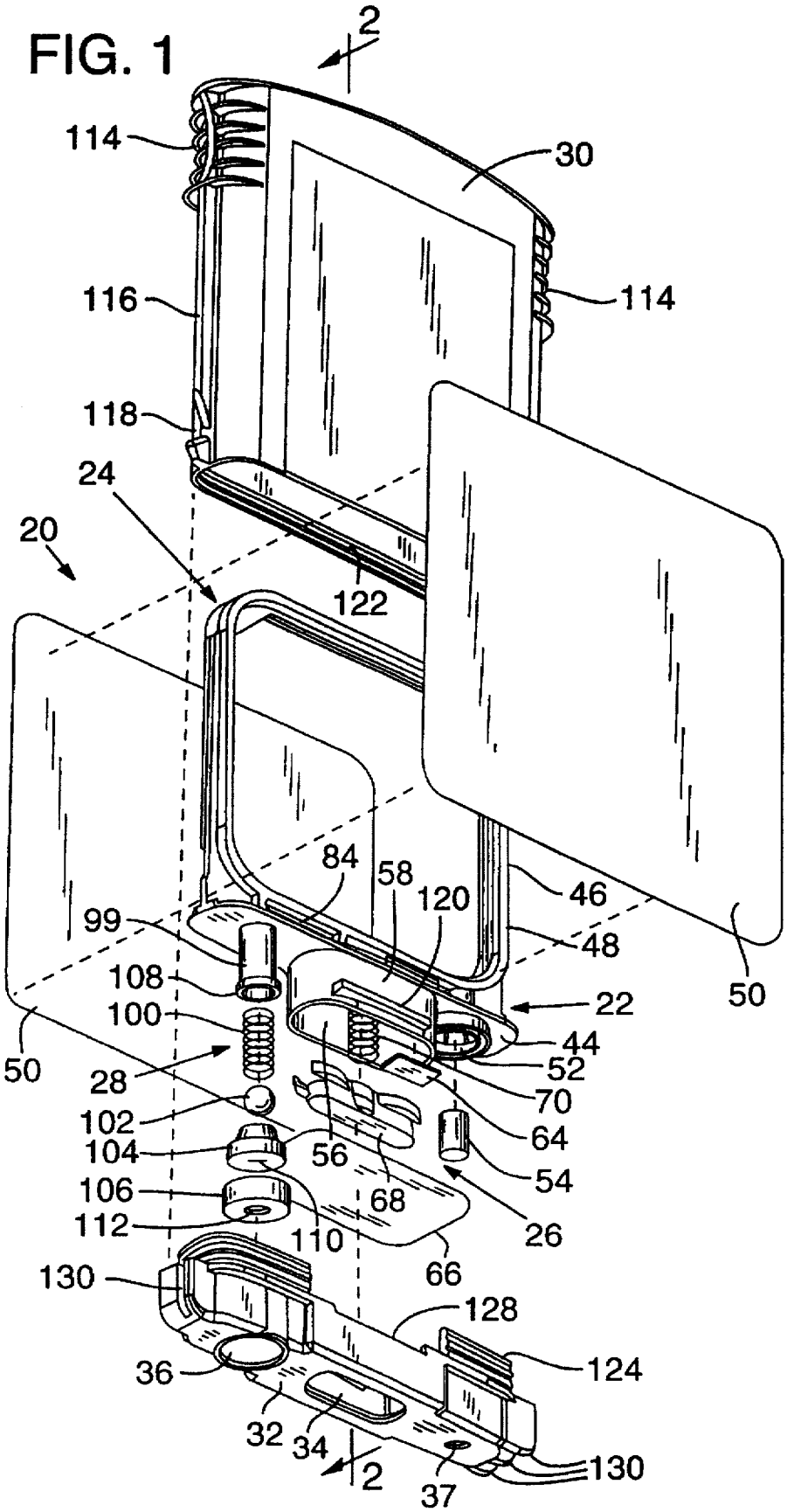
FIG. 1 is an exploded view of an ink supply for refilling in accordance with a preferred embodiment of the present invention.

An ink supply in accordance with a preferred embodiment of the present invention is illustrated in FIG. 1 as reference numeral 20. The ink supply 20 has a chassis 22 which carries an ink reservoir 24 for containing ink, a pump 26 and fluid outlet 28. The chassis 22 is enclosed within a hard protective shell 30 having a cap 32 affixed to its lower end. The cap 32 is provided with an aperture 34 to allow access to the pump 26 and an aperture to allow access to the fluid outlet 28.

To use the ink supply 20, it is inserted into a docking bay 38 of an ink-jet printer, as illustrated in FIGS. 7–11. Upon insertion of the ink supply 20, an actuator 40 within the docking bay 38 is brought into contact with the pump 26 through aperture 34. In addition, a fluid inlet 42 within the docking bay 38 is coupled to the fluid outlet 28 through aperture 36 to create a fluid path from the ink supply to the printer. Operation of the actuator 40 causes the pump 26 to draw ink from the reservoir 24 and supply the ink through the fluid outlet 28 and the fluid inlet 42 to the printer.

Upon depletion of the ink from the reservoir 24, or for any other reason, the ink supply 20 can be easily removed from the docking bay 38. Upon removal, the fluid outlet 28 and the fluid inlet 42 are closed to help prevent any residual ink from leaking into the printer or onto the user. The ink supply may then be discarded or stored for reinstallation at a later time.

Figure 13:
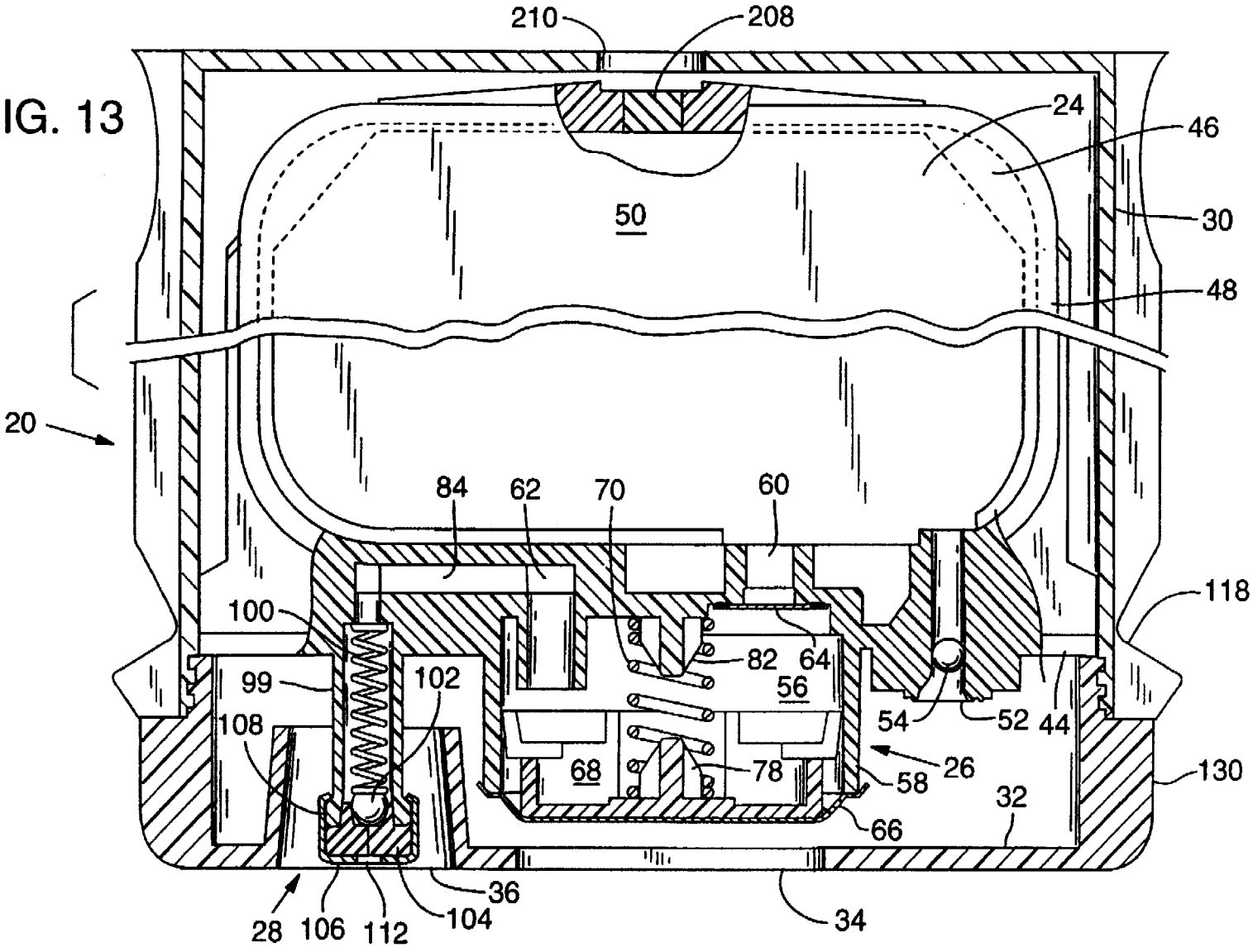
FIG. 13 shows a cross sectional view of an alternative embodiment of a refillable ink supply in accordance with the present invention.
Figures 12, 14, 15:
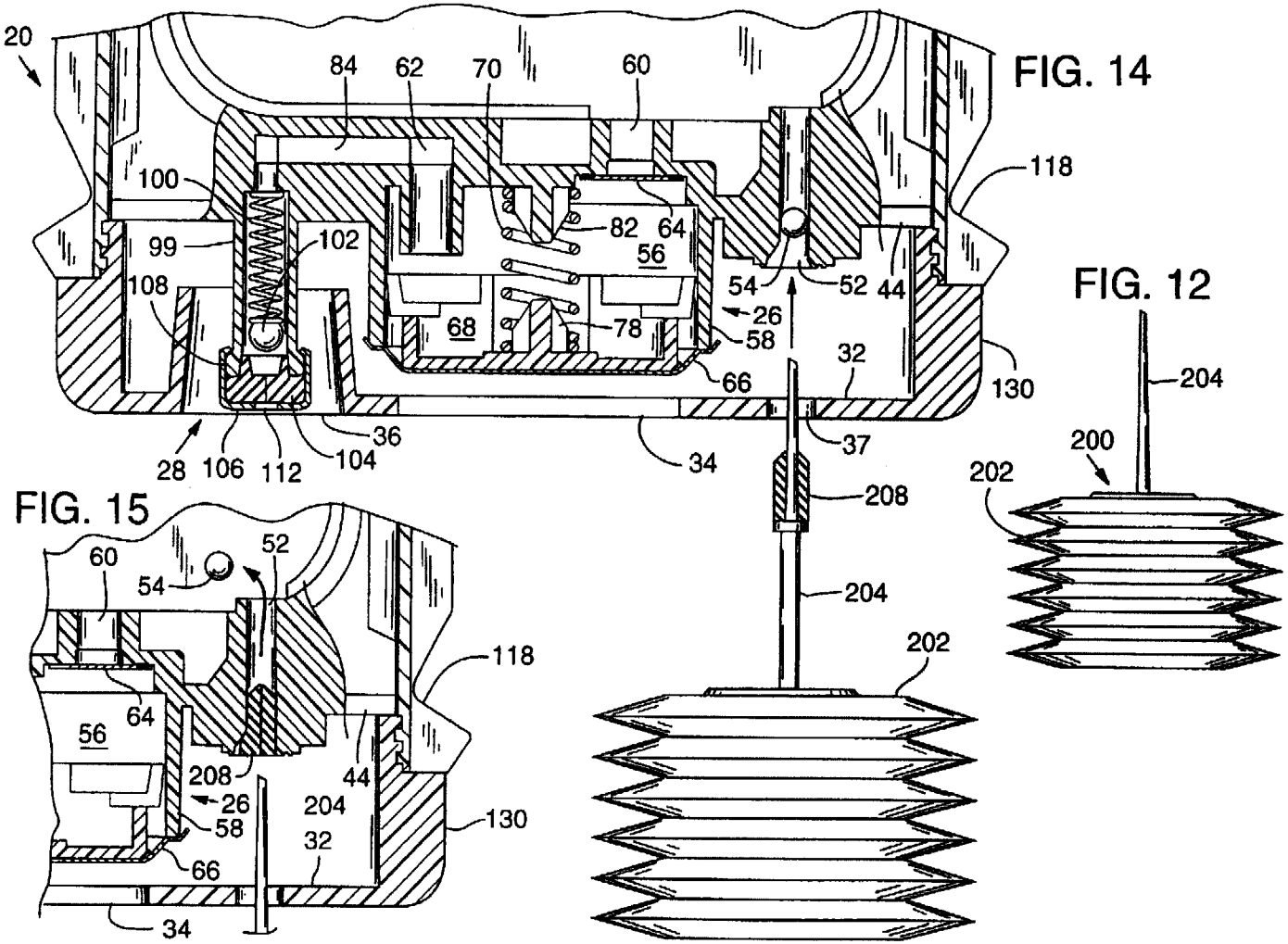
FIG. 12 shows a refill kit for refilling the ink supply of FIG. 1.
FIG. 14 shows another alternative embodiment of a refillable ink supply and refill kit in accordance with the present invention.
FIG. 15 shows the embodiment of FIG. 14 after refilling.

Alternatively, the ink supply may be reftlied using a refill kit 200 of the type illustrated in FIGS. 12 and 13. The refill kit 200 includes an ink containing refill reservoir 202 in fluid communication with a hollow needle 204. To use the refill kit, the needle 204 is inserted through a septum 54 provided in the ink supply 20. The refill reservoir 202 is then compressed to force ink from the refill reservoir into the reservoir 24. When the needle 204 is withdrawn, the septum 54 reseals to close the reservoir 24. In this manner, the present ink supply 20 provides a user of an ink-jet printer with a simple, economical way to provide a reliable, and easily refillable supply of ink to an ink-jet printer.

As illustrated in FIGS. 1–4, the chassis 22 has a main body 44. Extending upward from the top of the chassis body 44 is a frame 46 which helps define and support the ink reservoir 24. In the illustrated embodiment, the frame 46 defines a generally square reservoir 24 having a thickness determined by the thickness of the frame 46 and having open sides. Each side of the frame 46 is provided with a face 48 to which a sheet of plastic 50 is attached to enclose the sides of the reservoir 24. The illustrated plastic sheet is flexible to allow the volume of the reservoir to vary as ink is depleted from the reservoir. This helps to allow withdrawal and use of all of the ink within the reservoir by reducing the amount of backpressure created as ink is depleted from the reservoir. The illustrated ink supply 20 is intended to contain about 30 cubic centimeters of ink when full. Accordingly, the general dimensions of the ink reservoir defined by the frame are about 57 millimeters high, about 60 millimeters wide, and about 5.25 millimeters thick. These dimensions may vary depending on the desired size of the ink supply and the dimensions of the printer in which the ink supply is to be used.

In the illustrated embodiment, the plastic sheets 50 are heat staked to the faces 48 of the frame in a manner well known to those in the art. The plastic sheets 50 are, in the illustrated embodiment, multi-ply sheets having a an outer layer of low density polyethylene, a layer of adhesive, a layer of metallized polyethylene terephthalate, a layer of adhesive, a second layer of metallized polyethylene terephthalate, a layer of adhesive, and an inner layer of low density polyethylene. The layers of low density polyethylene are about 0.0005 inches thick and the metallized polyethylene terephthalate is about 0.00048 inches thick. The low density polyethylene on the inner and outer sides of the plastic sheets can be easily heat staked to the frame while the double layer of metallized polyethylene terephthalate provides a robust barrier against vapor loss and leakage. Of course, in other embodiments, different materials, alternative methods of attaching the plastic sheets to the frame, or other types of reservoirs might be used.

The body 44 of the chassis 22, as seen in FIGS. 1–4, is provided with a fill port 52 to allow ink to be introduced into the reservoir. After filling the reservoir, a plug 54 is inserted into the fill port 52 to prevent the escape of ink through the fill port. In the illustrated embodiment, the plug is a septum formed of a resilient material, such as polyisoprene rubber. As a result when in place within the fill port 52, the septum can be pierced by a needle and then reseal upon removal of the needle. In some embodiments, it may be desirable to pre-slit or pre-pierce the septum 54 to prevent tearing or coring during the piercing process.

A pump 26 is also carried on the body 44 of the chassis 22. The pump 26 serves to pump ink from the reservoir and supply it to the printer via the fluid outlet 28. In the illustrated embodiment, seen in FIGS. 1 and 2, the pump 26 includes a pump chamber 56 that is integrally formed with the chassis 22. The pump chamber is defined by a skirt-like wall 58 which extends downwardly from the body 44 of the chassis 22.

A pump inlet 60 is formed at the top of the chamber 56 to allow fluid communication between the chamber 56 and the ink reservoir 24. A pump outlet 62 through which ink may be expelled from the chamber 56 is also provided. A valve 64 is positioned within the pump inlet 60. The valve 64 allows the flow of ink from the ink reservoir 24 into the chamber 56 but limits the flow of ink from the chamber 56 back into the ink reservoir 24. In this way, when the chamber is depressurized, ink may be drawn from the ink reservoir, through the pump inlet and into the chamber. When the chamber is pressurized, ink within the chamber may be expelled through the pump outlet.

Figure 2:
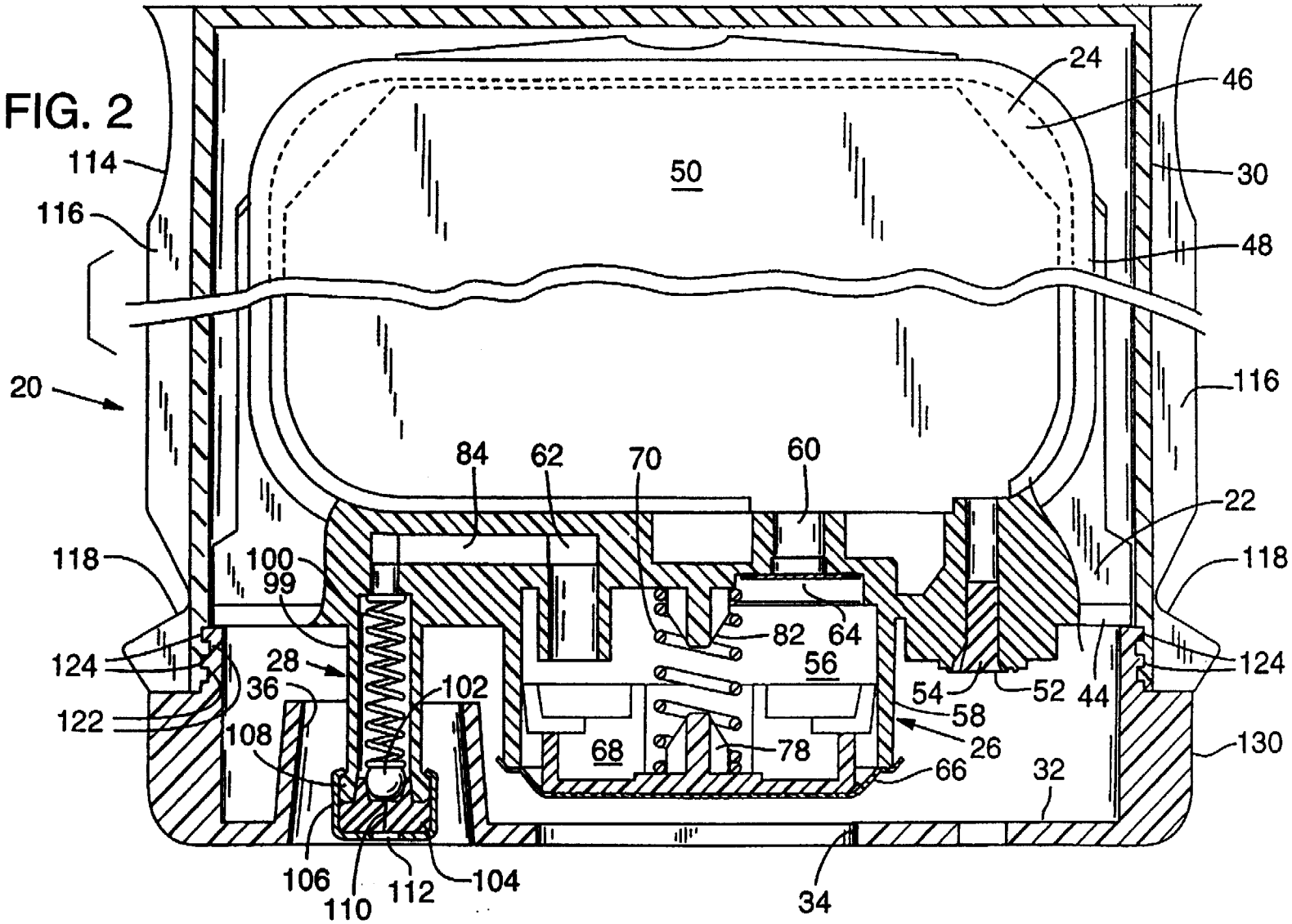
FIG. 2 is cross sectional view, taken along line 2—2 of FIG. 1, of a portion of the ink supply of FIG. 1.
Figure 3:
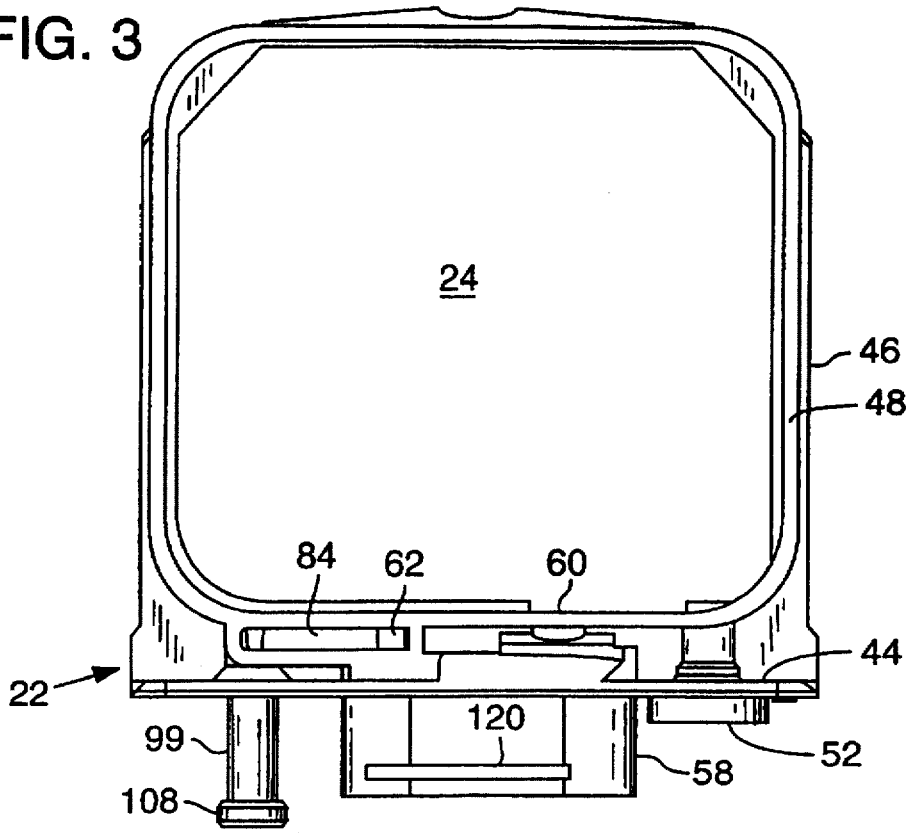
FIG. 3 is a side view of the chassis of the ink supply of FIG. 1.
Figure 4:
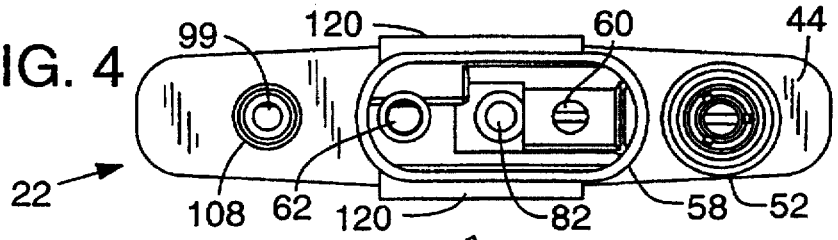
FIG. 4 is a bottom view of the chassis of FIG. 3.

In the illustrated embodiment, the valve 64 is a flapper valve positioned at the bottom of the pump inlet. The flapper valve 64 illustrated in FIGS. 1 and 2, is a rectangular piece of flexible material. The valve 64 is positioned over the bottom of the pump inlet 60 and heat staked to the chassis 22 at the midpoints of its short sides (the heat staked areas are darkened in the FIGS.). When the pressure within the chamber drops sufficiently below that in the reservoir, the unstaked sides of the valve each flex downward to allow the flow of ink around the valve 64, through the pump inlet 60 and into the chamber 56. In alternative embodiments, the flapper valve could be heat staked on only one side so that the entire valve would flex about the staked side, or on three sides so that only one side of the valve would flex. Other types of valves may also be suitable.

In the illustrated embodiment the flapper valve 64 is made of a two ply material. The top ply is a layer of low density polyethylene 0.0015 inches thick. The bottom ply is a layer of polyethylene terephthalate (PET) 0.0005 inches thick.

The illustrated flapper valve 64 is approximately 5.5 millimeters wide and 8.7 millimeters long. Of course, in other embodiments, other materials or other types or sizes of valves may be used.

A flexible diaphragm 66 encloses the bottom of the chamber 56. The diaphragm 66 is slightly larger than the opening at the bottom of the chamber 56 and is sealed around the bottom edge of the wall 58. The excess material in the oversized diaphragm allows the diaphragm to flex up and down to vary the volume within the chamber. In the illustrated ink supply, displacement of the diaphragm allows the volume of the chamber 56 to be varied by about 0.7 cubic centimeters. The fully expanded volume of the illustrated chamber 56 is between about 2.2 and 2.5 cubic centimeters.

In the illustrated embodiment, the diaphragm 66 is made of the same multi-ply material as the sheets 50. Of course, other suitable materials may also be used to form the diaphragm. The diaphragm in the illustrated embodiment is heat staked, using conventional methods, to the bottom edge of the skirt-like wall 58. During the heat staking process, the low density polyethylene in the diaphragm seals any folds or wrinkles in the diaphragm to create a leak proof connection.

Figure 5:
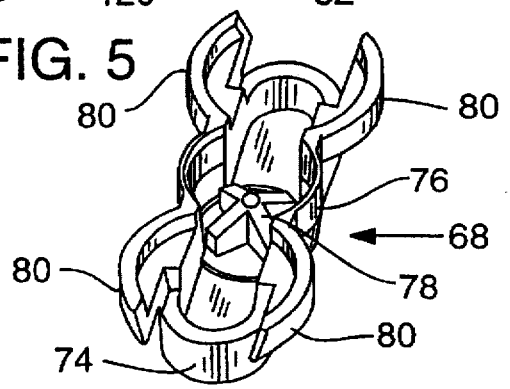
FIG. 5 is a top perspective view of the pressure plate of the ink supply of FIG. 1.
Figure 6:
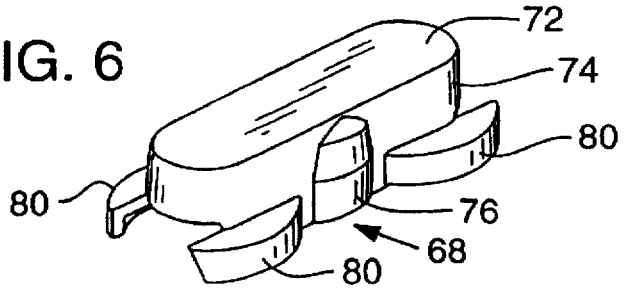
FIG. 6 is a bottom perspective view of the pressure plate of FIG. 5.

A pressure plate 68 and a spring 70 are positioned within the chamber 56. The pressure plate 68, illustrated in detail in FIGS. 5 and 6, has a smooth lower face 72 with a wall 74 extending upward about its perimeter. The central region 76 of the pressure plate 68 is shaped to receive the lower end of the spring 70 and is provided with a spring retaining spike 78. Four wings 80 extend laterally from an upper portion of the wall 74. The illustrated pressure plate is molded of high density polyethylene.

The pressure plate 68 is positioned within the chamber 56 with the lower face 72 adjacent the flexible diaphragm 66. The upper end of the spring 70, which is stainless steel in the illustrated embodiment, is retained on a spike 82 formed in the chassis and the lower end of the spring 70 is retained on the spike 78 on the pressure plate 68. In this manner, the spring biases the pressure plate downward against the diaphragm to increase the volume of the chamber. The wall 74 and wings 80 serve to stabilize the orientation of the pressure plate while allowing for its free, piston-like movement within the chamber 56. The structure of the pressure plate, with the wings extending outward from the smaller face, provides clearance for the heat stake joint between the diaphragm and the wall and allows the diaphragm to flex without being pinched as the pressure plate moves up and down. The wings are also spaced to facilitate fluid flow within the pump.

As illustrated in FIG. 2, a conduit 84 joins the pump outlet 62 to the fluid outlet 28. In the illustrated embodiment, the top wall of the conduit 84 is formed by the lower member of the frame 46, the bottom wall is formed by the body 44 of the chassis, one side is enclosed by a portion of the chassis and the other side is enclosed by a portion of one of the plastic sheets 50.

As illustrated in FIGS. 1 and 2, the fluid outlet 28 is housed within a hollow cylindrical boss 99 that extends downward from the chassis 22. The top of the boss 99 opens into the conduit 84 to allow ink to flow from the conduit into the fluid outlet. A spring 100 and sealing ball 102 are positioned within the boss 99 and are held in place by a compliant septum 104 and a crimp cover 106. The length of the spring 100 is such that it can be placed into the inverted boss 99 with the ball 102 on top. The septum 104 can then inserted be into the boss 99 to compress the spring 100 slightly so that the spring biases the sealing ball 102 against the septum 104 to form a seal. The crimp cover 106 fits over the septum 104 and engages an annular projection 108 on the boss 99 to hold the entire assembly in place.

In the illustrated embodiment, both the spring 100 and the ball 102 are stainless steel. The sealing ball 102 is sized such that it can move freely within the boss 99 and allow the flow of ink around the ball when it is not in the sealing position. The septum 104 is formed of polyisoprene rubber and has a concave bottom to receive a portion of the ball 102 to form a secure seal. The septum 104 is provided with a slit 110 so that it may be easily pierced without tearing or coring. However, the slit is normally closed such that the septum itself forms a second seal. The slit may, preferably, be slightly tapered with its narrower end adjacent the ball 102. The illustrated crimp cover 106 is formed of aluminum and has a thickness of about 0.020 inches. A hole 112 is provided so that the crimp cover 106 does not interfere with the piercing of the septum 104.

With the pump and fluid outlet in place, the ink reservoir 24 can be filled with ink. To fill the ink reservoir 24, ink can be injected through the fill port 52. As ink is being introduced into the reservoir, a needle (not shown) can be inserted through the slit 110 in the septum 104 to depress the sealing ball 102 and allow the escape of any air from within the reservoir. Alternatively, a partial vacuum can be applied through the needle. The partial vacuum at the fluid outlet causes ink from the reservoir 24 to fill the chamber 56, the conduit 84, and the cylindrical boss 99 such that little, if any, air remains in contact with the ink. The partial vacuum applied to the fluid outlet also speeds the filling process. Once the ink supply is filled, the septum 54 is pressed into the fill port to prevent the escape of ink or the entry of air. Alternatively, the septum may be pressed into place prior to filling the ink supply. If this is done, the septum 54 can be pierced with a hollow needle or the like to allow ink to be introduced into the ink supply.

Of course, there are a variety of other methods which might also be used to fill the present ink supply. In some instances, it may be desirable to flush the entire ink supply with carbon dioxide prior to filling it with ink. In this way, any gas trapped within the ink supply during the filling process will be carbon dioxide, not air. This may be preferable because carbon dioxide may dissolve in some inks while air may not. In general, it is preferable to remove as much gas from the ink supply as possible so that bubbles and the like do not enter the print head or the trailing tube. To this end, it may also be preferable to use alegassed ink to further avoid the creation or presence of bubbles in the ink supply.

Although the ink reservoir 24 provides an ideal way to contain ink, it may be easily punctured or ruptured and may allow some amount of water loss from the ink. Accordingly, to protect the reservoir 24 and to further limit water loss, the reservoir 24 is enclosed within a protective shell 30. In the illustrated embodiment, the shell 30 is made of clarified polypropylene. A thickness of about one millimeter has been found to provide robust protection and to prevent unacceptable water loss from the ink. However, the material and thickness of the shell may vary in other embodiments.

As illustrated in FIG. 1, the top of the shell 30 has contoured gripping surfaces 114 that are shaped and textured to allow a user to easily grip and manipulate the ink supply 20. A vertical rib 116 having a detente 118 formed near its lower end projects laterally from each side of the shell 30. The base of the shell 30 is open to allow insertion of the chassis 22. A stop 120 extends laterally outward from each side of the wall 58 that defines the chamber 56. These stops 120 abut the lower edge of the shell 30 when the chassis 22 is inserted.

A protective cap 32 is fitted to the bottom of the shell 30 to maintain the chassis 22 in position. The cap 32 is provided with recesses 128 which receive the stops 120 on the chassis 22. In this manner, the stops are firmly secured between the cap and the shell to maintain the chassis in position. The cap is also provided with an aperture 34 to allow access to the pump 26 and with an aperture 36 to allow access to the fluid outlet 28. The cap 32 may also be provided with an aperture 37 to allow access to the fill port to allow refilling of the ink supply.

The cap is provided with projecting keys 130 which can identify the type of printer for which the ink supply is intended and the type of ink contained within the ink supply. For example, if the ink supply is filled with black ink, a cap having keys that indicate black ink may be used. Similarly, if the ink supply is filled with a particular color of ink, a cap indicative of that color may be used. The color of the cap may also be used to indicate the color of ink contained within the ink supply.

As a result of this structure, the chassis and shell can be manufactured and assembled without regard to the particular type of ink they will contain. Then, after the ink reservoir is filled, a cap indicative of the particular ink used is attached to the shell. This allows for manufacturing economies because a supply of empty chassis and shells can be stored in inventory. Then, when there is a demand for a particular type of ink, that ink can be introduced into the ink supply and an appropriate cap fixed to the ink supply. Thus, this scheme reduces the need to maintain high inventories of ink supplies containing every type of ink.

In the illustrated embodiment, the bottom of the shell 30 is provided with two circumferential grooves 122 which engage two circumferential ribs 124 formed on the cap 32 to secure the cap to the shell. Sonic welding or some other mechanism may also be desirable to more securely fix the cap to the shell. In addition, a label (not shown) can be adhered to both the cap and the shell to more firmly secure them together. In the illustrated embodiment, pressure sensitive adhesive is used to adhere the label.

The attachment between the shell, the chassis and the cap should, preferably, be snug enough to prevent accidental separation of the cap from the shell and to resist the flow of ink from the shell should the ink reservoir develop a leak. However, it is also desirable that the attachment allow the slow ingress of air into the shell as ink is depleted from the reservoir to maintain the pressure inside the shell generally the same as the ambient pressure. Otherwise, a negative pressure may develop inside the shell and inhibit the flow of ink from the reservoir. The ingress of air should be limited, however, in order to maintain a high humidity within the shell and minimize water loss from the ink.

In some embodiments, it may be desirable to allow removal of the cap to facilitate refilling of the ink reservoir. That is, the cap could be removed from the shell to allow access to the fill port for refilling. Upon completion of the refilling process, the cap could be replaced. In these embodiments, the aperture 37 in the cap would be unnecessary.

In the illustrated embodiment, the shell 30 and the flexible reservoir 24 which it contains have the capacity to hold approximately thirty cubic centimeters of ink. The shell is approximately 67 millimeters wide, 15 millimeters thick, and 60 millimeters high. Of course, other dimensions and shapes can also be used depending on the particular needs of a given printer.

Figure 7:
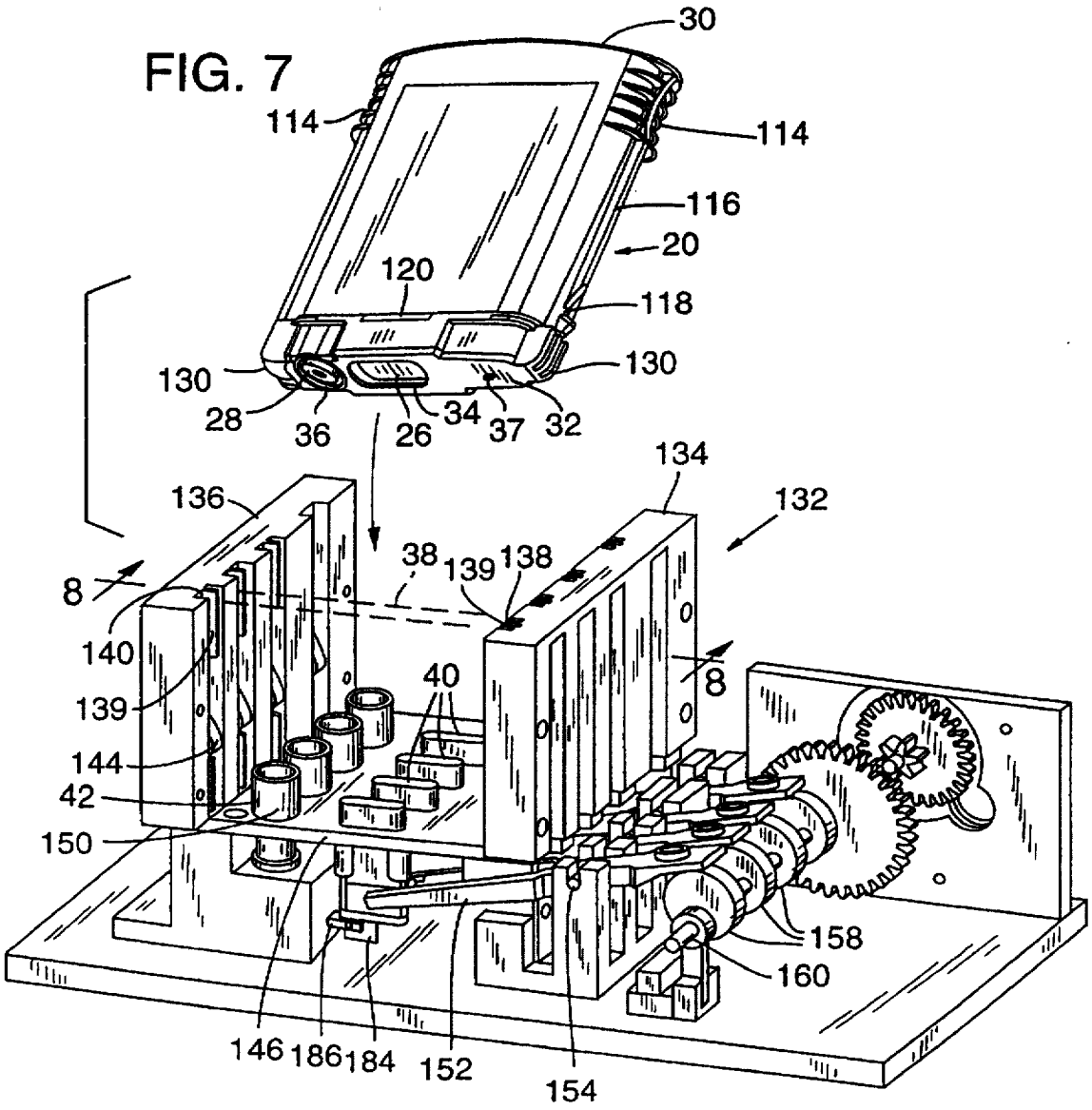
FIG. 7 shows the ink supply if FIG. 1 being inserted into a docking bay of an ink-jet printer.

The illustrated ink supply 20 is ideally suited for insertion into a docking station 132 like that illustrated in FIGS. 7–10. The docking station 132 illustrated in FIG. 7, is intended for use with a color printer. Accordingly, it has four side-by-side docking bays 38, each of which can receive one ink supply 20 of a different color. The structure of the illustrated ink supply allows for a relatively narrow width. This allows for four ink supplies to be arranged side-by-side in a compact docking station without unduly increasing the "footprint" of the printer.

Each docking bay 38 includes opposing walls 134 and 136 which define inwardly facing vertical channels 138 and 140. A leaf spring 142 having an engagement prong 144 is positioned within the lower portion of each channel 138 and 140. The engagement prong 144 of each leaf spring 142 extends into the channel toward the docking bay 38 and is biased inward by the leaf spring. The channels 138 and 140 are provided with mating keys 139 formed therein. In the illustrated embodiment, the mating keys in the channels on one wall are the same for each docking bay and identify the type of printer in which the docking station is used. The mating keys in the channels of the other wall are different for each docking bay and identify the color of ink for use in that docking bay. A base plate 146 defines the bottom of each docking bay 38. The base plate 146 includes an aperture 148 which receives the actuator 40 and carries a housing 150 for the fluid inlet 42.

As illustrated in FIG. 7, the upper end of the actuator extends upward through the aperture 148 in the base plate 146 and into the docking bay 38. The lower portion of the actuator 40 is positioned below the base plate and is pivotably coupled to one end of a lever 152 which is supported on pivot point 154. The other end of the lever 154 is biased downward by a compression spring 156. In this manner, the force of the compression spring 156 urges the actuator 40 upward. A cam 158 mounted on a rotatable shaft 160 is positioned such that rotation of the shaft to an engaged position causes the cam to overcome the force of the compression spring 156 and move the actuator 40 downward. Movement of the actuator, as explained in more detail below, causes the pump 26 to draw ink from the reservoir 24 and supply it through the fluid outlet 28 and the fluid inlet 42 to the printer.

Figure 10:
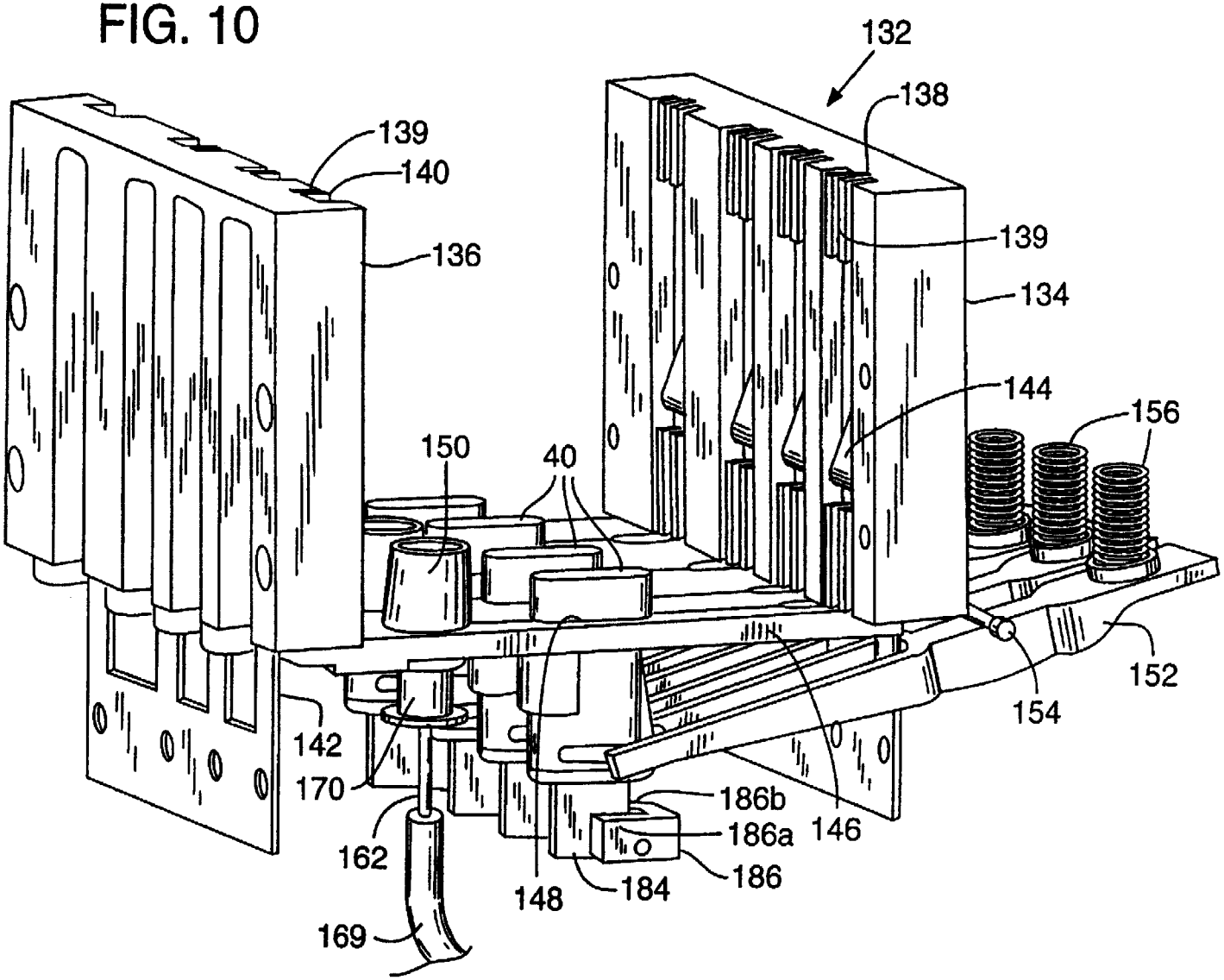
FIG. 10 shows the docking bay of FIG. 7 with a portion of the docking bay cutaway to reveal an out-of-ink detector.

As illustrated in FIG. 10, a flag 184 extends downward from the bottom of the actuator 40 where it is received within an optical detector 186. The optical detector 186 is of conventional construction and directs a beam of light from one leg **186*a* toward a sensor (not shown) positioned on the other 186*b* leg. The optical detector is positioned such that when the actuator 40 is in its uppermost position, corresponding to the top of the pump stroke, the flag 184** raises above the beam of light allowing it to reach the sensor and activate the detector. In any lower position, the flag blocks the beam of light and prevents it from reaching the sensor and the detector is in a deactivated state. In this manner, the sensor can be used, as explained more fully below, to control the operation of the pump and to detect when an ink supply is empty.

Figure 8:
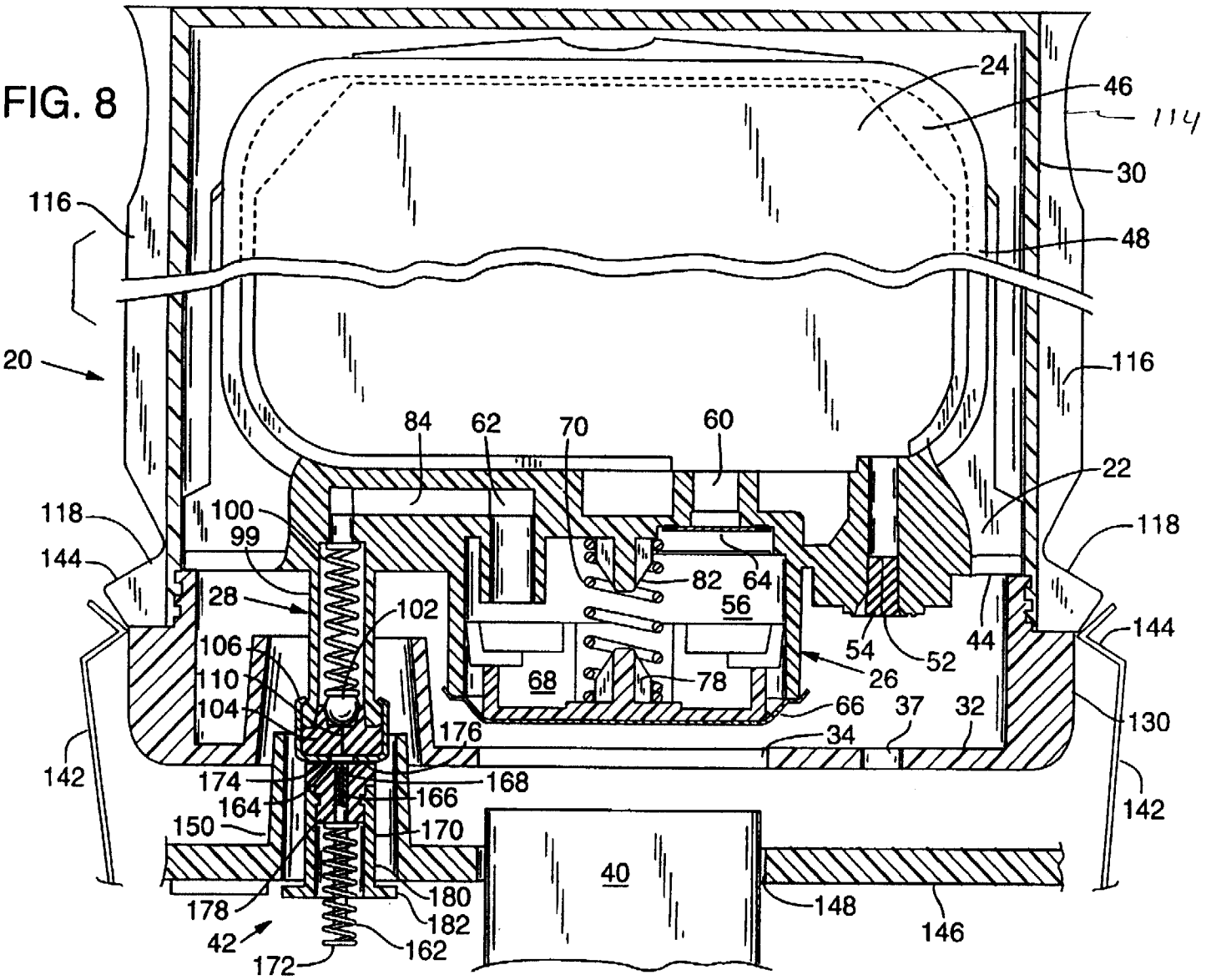
FIG. 8 is a cross sectional view of a part of the ink supply of FIG. 1 being inserted into the docking bay of an ink-jet printer, taken along line 8—8 of FIG. 7.

As seen in FIG. 8, the fluid inlet 42 is positioned within the housing 150 carried on the base plate 146. The illustrated fluid inlet 42 includes an upwardly extending needle 162 having a closed, blunt upper end 164, a blind bore 166 and a lateral hole 168. A trailing tube 169, seen in FIG. 10, is connected to the lower end of the needle 162 in fluid communication with the blind bore 166. The trailing tube 169 leads to a print head (not shown). In most printers, the print head will usually include a small ink well for maintaining a small quantity of ink and some type of pressure regulator to maintain an appropriate pressure within the ink well. Typically, it is desired that the pressure within the ink well be slightly less than ambient. This "back pressure" helps to prevent ink from dripping from the print head. The pressure regulator at the print head may commonly include a check valve which prevents the return flow of ink from the print head and into the trailing tube.

A sliding collar 170 surrounds the needle 162 and is biased upwardly by a spring 172. The sliding collar 170 has a compliant sealing portion 174 with an exposed upper surface 176 and an inner surface 178 in direct contact with the needle 162. In addition, the illustrated sliding collar includes a substantially rigid portion 180 extending downwardly to partially house the spring 172. An annular stop 182 extends outward from the lower edge of the substantially rigid portion 180. The annular stop 182 is positioned beneath the base plate 146 such that it abuts the base plate to limit upward travel of the sliding collar 170 and define an upper position of the sliding collar on the needle 162. In the upper position, the lateral hole 168 is surrounded by the sealing portion 174 of the collar to seal the lateral hole and the blunt end 164 of the needle is generally even with the upper surface 176 of the collar.

In the illustrated embodiment, the needle 162 is an eighteen gauge stainless steel needle with an inside diameter of about 1.04 millimeters, an outside diameter of about 1.2 millimeters, and a length of about 30 millimeters. The lateral hole is generally rectangular with dimensions of about 0.55 millimeters by 0.70 millimeters and is located about 1.2 millimeters from the upper end of the needle. The sealing portion 174 of the sliding collar is made of ethylene propylene dimer monomer and the generally rigid portion 176 is made of polypropylene or any other suitably rigid material. The sealing portion is molded with an aperture to snugly receive the needle and form a robust seal between the inner surface 178 and the needle 162. In other embodiments, alternative dimensions, materials or configurations might also be used.

To install an ink supply 20 within the docking bay 38, a user can simply place the lower end of the ink supply between the opposing walls 134 and 136 with one edge in one vertical channel 138 and the other edge in the other vertical channel 140, as shown in FIG. 7. The ink supply is then pushed downward into the installed position, shown in FIG. 9, in which the bottom of the cap 32 abuts the base plate 146. As the ink supply is pushed downward, the fluid outlet 28 and fluid inlet 42 automatically engage and open to form a path for fluid flow from the ink supply to the printer, as explained in more detail below. In addition, the actuator enters the aperture 34 in the cap 32 to pressurize the pump, as explained in more detail below.

Once in position, the engagement prongs 144 on each side of the docking station engage the detentes 118 formed in the shell 30 to firmly hold the ink supply in place. The leaf springs 142, which allow the engagement prongs to move outward during insertion of the ink supply, bias the engagement prongs inward to positively hold the ink supply in the installed position. Throughout the installation process and in the installed position, the edges of the ink supply 20 are captured within the vertical channels 138 and 140 which provide lateral support and stability to the ink supply. In some embodiments, it may be desirable to form grooves in one or both of the channels 138 and 140 which receive the vertical rib 116 formed in the shell to provide additional stability to the ink supply.

To remove the ink supply 20, a user simply grasps the ink supply, using the contoured gripping surfaces 114, and pulls upward to overcome the force of the leaf springs 142. Upon removal, the fluid outlet 28 and fluid inlet 42 automatically disconnect and reseal leaving little, if any, residual ink and the pump 26 is depressurized to reduce the possibility of any leakage from the ink supply.

Figure 9:
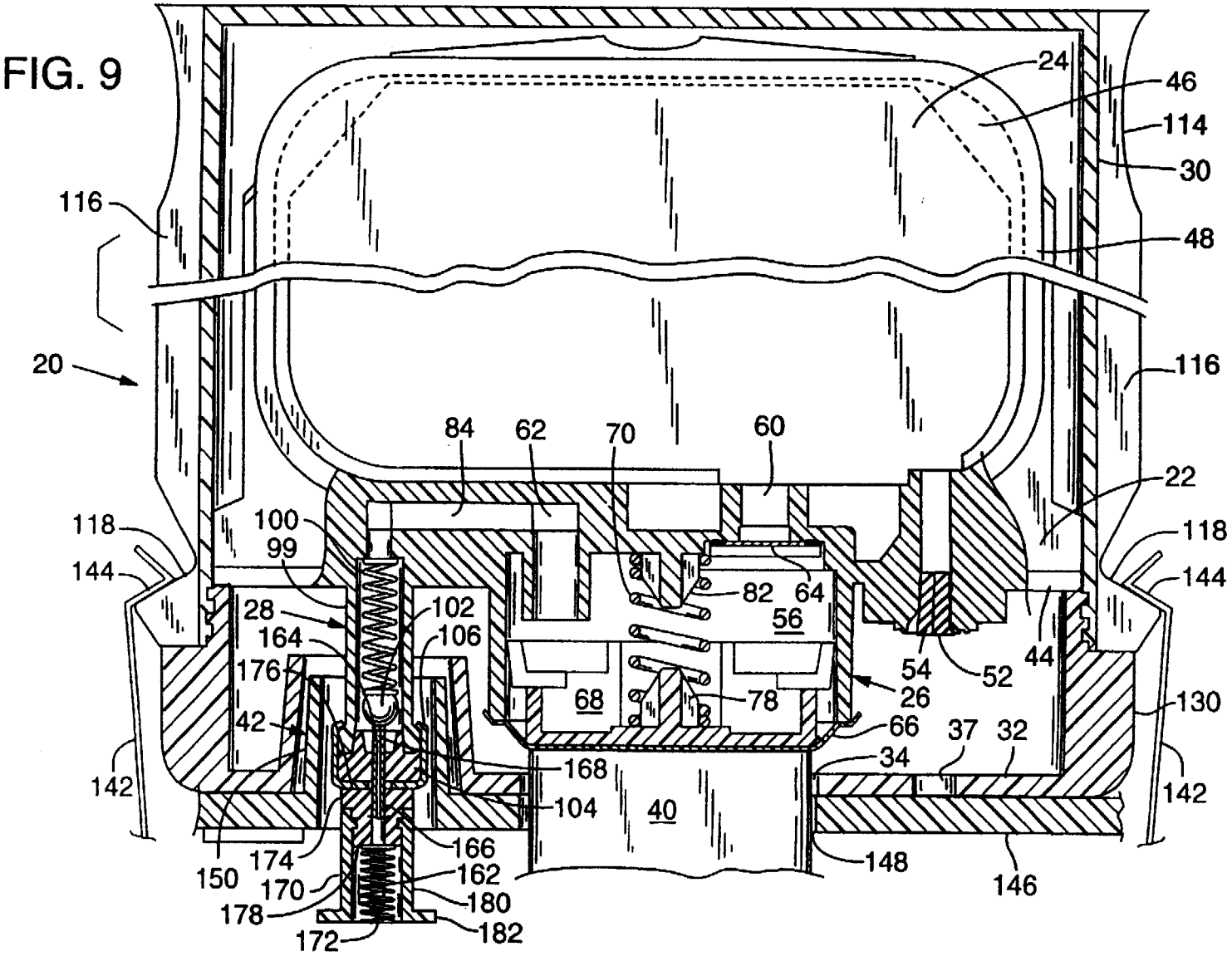
FIG. 9 is a cross sectional view showing the ink supply of FIG. 8 fully inserted into the docking bay.

Operation of the fluid interconnect, that is the fluid outlet 28 and the fluid inlet 42, during insertion of the ink supply is illustrated in FIGS. 8 and 9. FIG. 8 shows the fluid outlet 28 upon its initial contact with the fluid inlet 42. As illustrated in FIG. 8, the housing 150 has partially entered the cap 32 through aperture 36 and the lower end of the fluid outlet 28 has entered into the top of the housing 150. At this point, the crimp cover 106 contacts the sealing collar 170 to form a seal between the fluid outlet 28 and the fluid inlet 42 while both are still in their sealed positions. This seal acts as a safety barrier in the event that any ink should leak through the septum 104 or from the needle 162 during the coupling and decoupling process.

In the illustrated configuration, the bottom of the fluid inlet and the top of the fluid outlet are similar in shape. Thus, very little air is trapped within the seal between the fluid outer of the ink supply and the fluid inlet of the printer. This facilitates proper operation of the printer by reducing the possibility that air will enter the fluid outlet 28 or the fluid inlet 42 and reach the ink jets in the print head.

As the ink supply 20 is inserted further into the docking bay 38, the bottom of the fluid outlet 28 pushes the sliding collar 170 downward, as illustrated in FIG. 9. Simultaneously, the needle 162 enters the slit 110 and passes through the septum 104 to depress the sealing ball 102. Thus, in the fully inserted position, ink can flow from the boss 99, around the sealing ball 102, into the lateral hole 168, down the bore 166, through the trailing tube 169 to the print head.

Upon removal of the ink supply 20, the needle 162 is withdrawn and the spring 100 presses the sealing ball 102 firmly against the septum to establish a robust seal. In addition, the slit 110 closes to establish a second seal, both of which serve to prevent ink from leaking through the fluid outlet 28. At the same time, the spring 172 pushes the sliding collar 170 back to its upper position in which the lateral hole 168 is encased within the sealing portion of the collar 174 to prevent the escape of ink from the fluid inlet 42. Finally, the seal between the crimp cover 106 and the upper surface 176 of the sliding collar is broken. With this fluid interconnect, little, if any, ink is exposed when the fluid outlet 28 is separated from the fluid inlet 42. This helps to keep both the user and the printer clean.

Although the illustrated fluid outlet 28 and fluid inlet 42 provide a secure seal with little entrapped air upon sealing and little excess ink upon unsealing, other fluid interconnections might also be used to connect the ink supply to the printer.

Figure 11A:
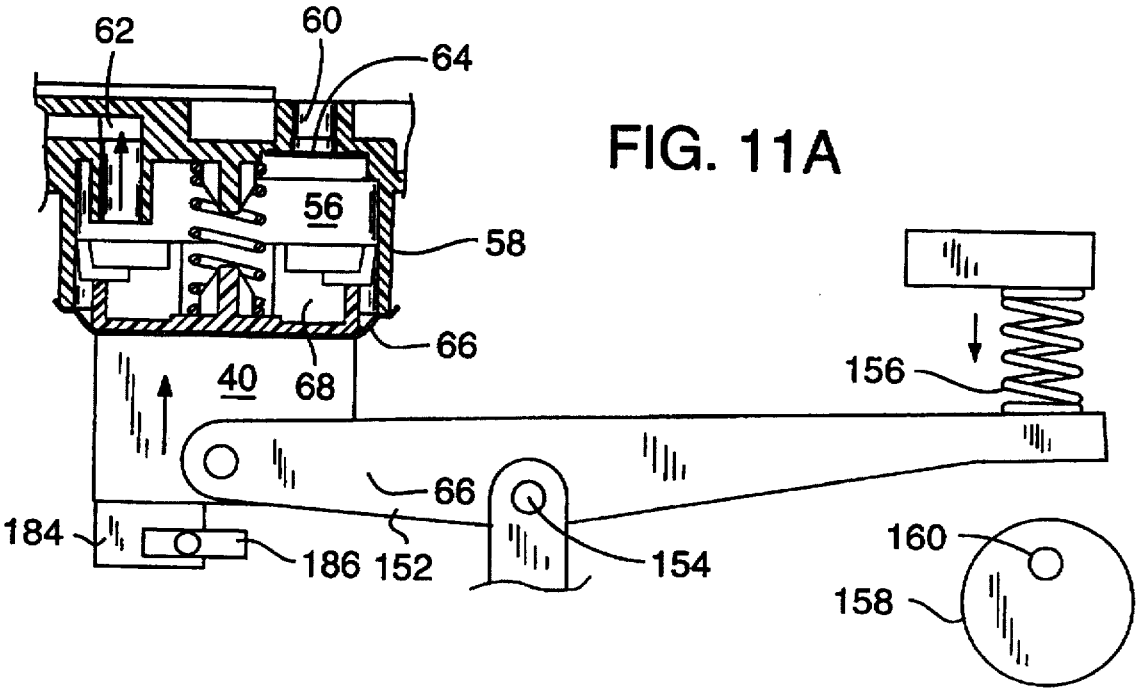
FIGS. 11A–11E are cross sectional views of a portion of the ink supply and docking bay showing the pump, actuator and out-of-ink detector in various stages of operation, taken along line 11—11 of FIG. 10.

As illustrated in FIG. 9, when the ink supply 20 is inserted into the docking bay 38, the actuator 40 enters through the aperture 34 in the cap 32 and into position to operate the pump 26. FIGS. 11A–E illustrate various stages of the pump's operation. FIG. 11A illustrates the fully charged position of the pump 26. The flexible diaphragm 66 is in its lowermost position, the volume of the chamber 56 is at its maximum, and the flag 184 is blocking the light beam from the sensor. The actuator 40 is pressed against the diaphragm 66 by the compression spring 156 to urge the chamber to a reduced volume and create pressure within the pump chamber 56. As the valve 64 limits the flow of ink from the chamber back into the reservoir, the ink passes from the chamber through the pump outlet 62 and the conduit 84 to the fluid outlet 28. In the illustrated embodiment, the compression spring is chosen so as to create a pressure of about 1.5 pounds per square inch within the chamber. Of course, the desired pressure may vary depending on the requirements of a particular printer and may vary throughout the pump stroke. For example, in the illustrated embodiment, the pressure within the chamber will vary from about 90–45 inches of water column during the pump stroke.

Figure 11B:
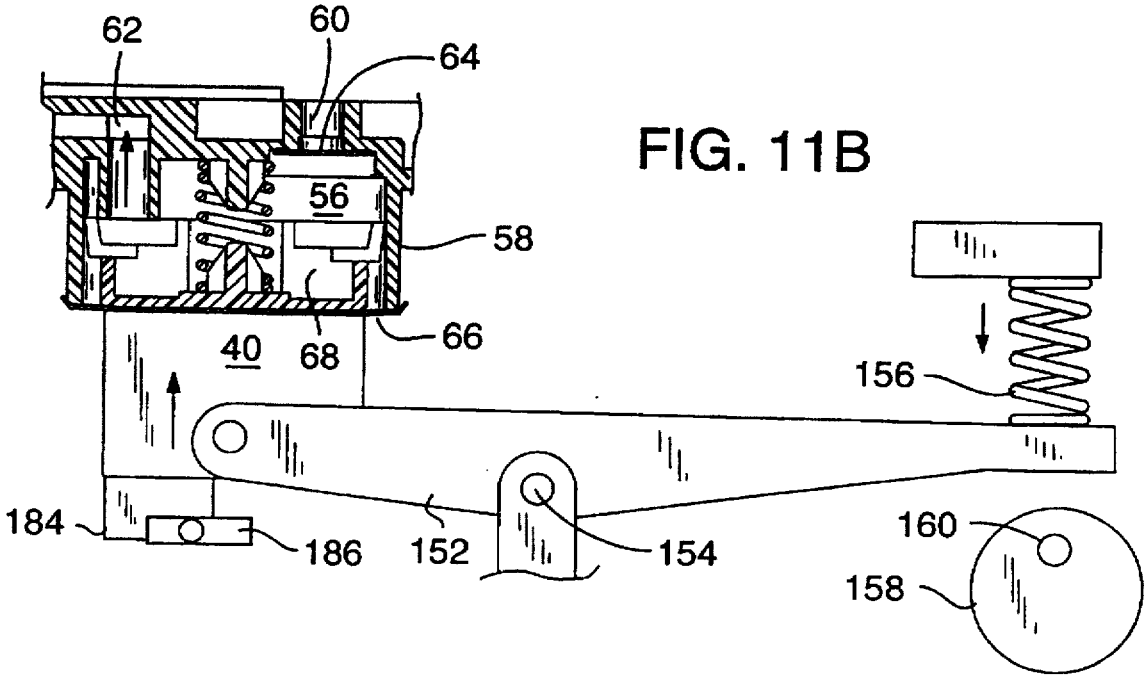

As ink is depleted from the pump chamber 56, the compression spring 156 continues to press the actuator 40 upward against the diaphragm 66 to maintain pressure within the pump chamber 56. This causes the diaphragm to move upward to an intermediate position decreasing the volume of the chamber, as illustrated in FIG. 11B. In the intermediate position, the flag 184 continues to block the beam of light from reaching the sensor in the optical detector 186.

Figure 11C:
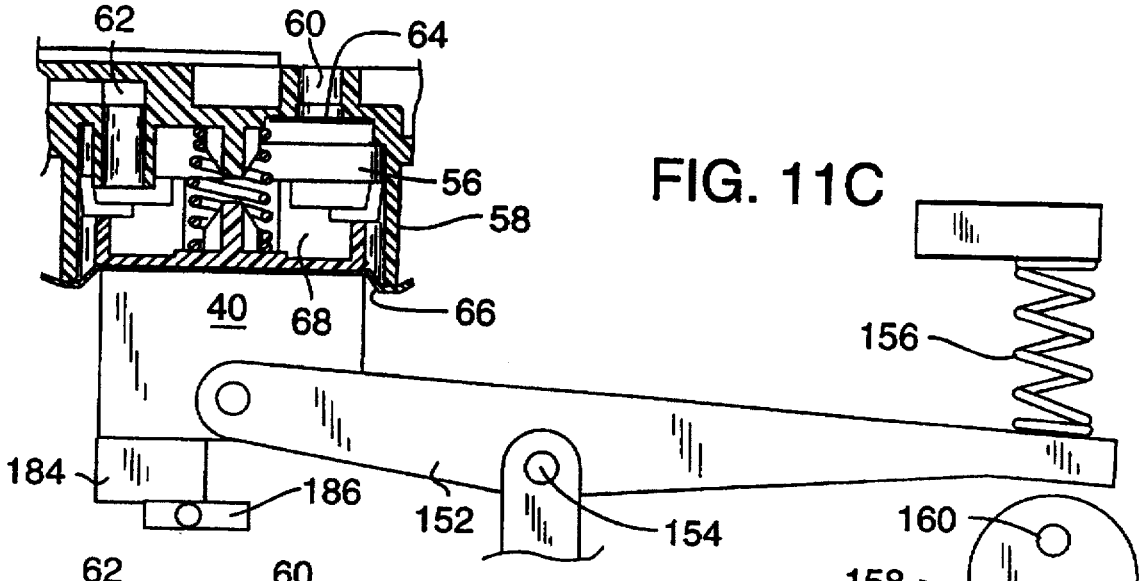

As still more ink is depleted from the pump chamber 56, the diaphragm 40 is pressed to its uppermost position, illustrated in FIG. 11C. In the uppermost position, the volume of the chamber 56 is at its minimum operational volume and the flag 184 rises high enough to allow the light beam to reach the sensor and activate the optical detector 186.

Figure 11D:
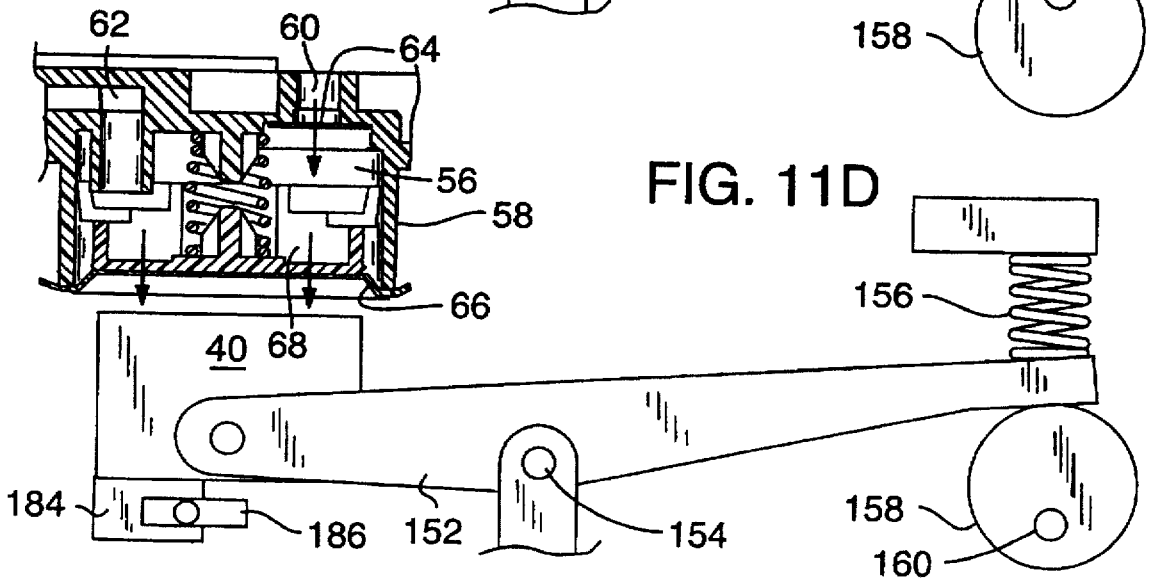

The printer control system (not shown) detects activation of the optical detector 186 and begins a refresh cycle. As illustrated in FIG. 11D, during the refresh cycle the cam 158 is rotated into engagement with the lever 152 to compress the compression spring 156 and move the actuator 40 to its position. In this position, the actuator 40 does not contact the diaphragm 66.

With the actuator 40 no longer pressing against the diaphragm 66, the pump spring 70 biases the pressure plate 68 and diaphragm 66 outward, expanding the volume and decreasing the pressure within the chamber 56. The decreased pressure within the chamber 56 allows the valve 64 to open and draws ink from the reservoir 24 into the chamber 56 to refresh the pump 26, as illustrated in FIG. 11D. The check valve at the print head, the flow resistance within the trailing tube, or both will limit ink from returning to the chamber 56 through the conduit 84. Alternatively, a check valve may be provided at the outlet port, or at some other location, to prevent the return of ink through the outlet port and into the chamber.

After a predetermined amount of time has elapsed, the refresh cycle is concluded by rotating the cam 158 back into its disengaged position and the ink supply typically returns to the configuration illustrated in FIG. 11A.

Figure 11E:
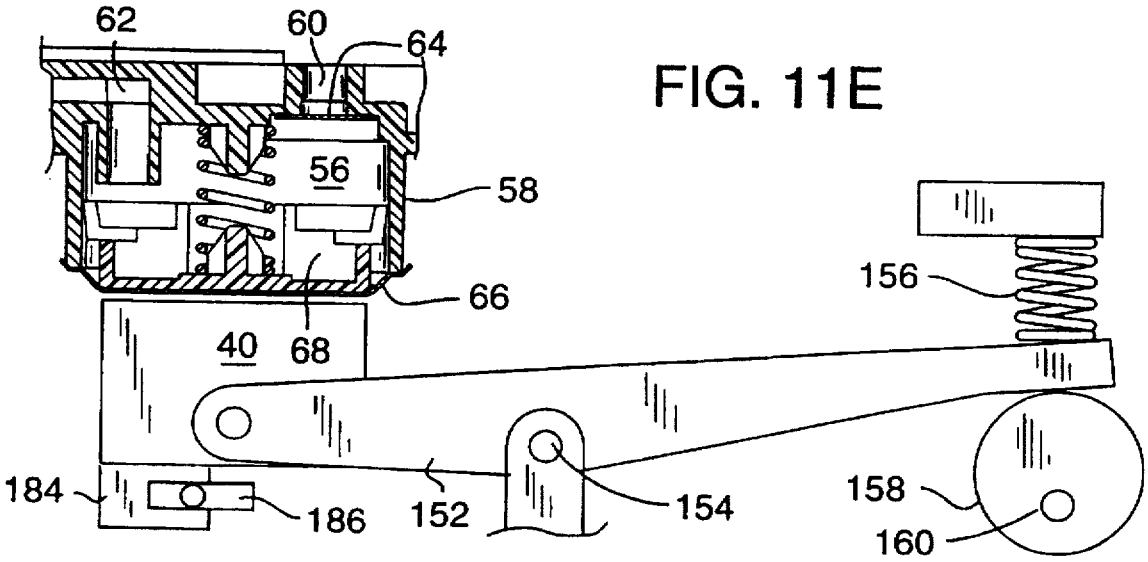

However, if the ink supply is out of ink, no ink can enter into the pump chamber 56 during a refresh cycle. In this case, the backpressure within the ink reservoir 24 will prevent the chamber 56 from expanding. As a result, when the cam 158 is rotated back into its disengaged position, the actuator 40 returns to its uppermost position, as illustrated in FIG. 11E, and the optical detector 186 is again activated. Activation of the optical detector immediately after a refresh cycle, informs the control system that the ink supply is out of ink (or possibly that some other malfunction is preventing the proper operation of the ink supply). In response, the control system can generate a signal informing the user that the ink supply requires replacement. This can greatly extend the life of the print head by preventing "dry" firing of the ink jets.

In some embodiments in may be desirable to rotate the cam 158 to the disengaged position and remove pressure from the chamber 56 whenever the printer is not printing. It should be appreciated that a mechanical switch, an electrical switch or some other type of switch capable of detecting the position of the actuator could be used in place of the optical detector.

The configuration of the present ink supply is particularly advantageous because only the relatively small amount of ink within the chamber is pressurized. The large majority of the ink is maintained within the reservoir at approximately ambient pressure. Thus, it is less likely to leak and, in the event of a leak, can be more easily contained.

The illustrated diaphragm pump has proven to be very reliable and well suited for use in the ink supply. However, other types of pumps may also be used. For example, a piston pump, a bellows pump, or other types of pumps might be adapted for use with the present invention.

As discussed above, the illustrated docking station 132 includes four side-by-side docking bays 38. This configuration allows the wall 134, the wall 136 and the base plate 146 for the four docking bays to be unitary. In the illustrated embodiment, the leaf springs for each side of the four docking bays can be formed as a single piece connected at the bottom. In addition, the cams 158 for each docking station are attached to a single shaft 160. Using a single shaft results in each of the four ink supplies being refreshed when the pump of any one of the four reaches its minimum operational volume. Alternatively, it may be desirable to configure the cams and shaft to provide a third position in which only the black ink supply is pressurized. This allows the colored ink supplies to remain at ambient pressure during a print job that requires only black ink.

The arrangement of four side-by-side docking bays is intended for use in a color printer. One of the docking bays is intended to receive an ink supply containing black ink, one an ink supply containing yellow ink, one an ink supply containing cyan ink, and one an ink supply containing magenta ink. The mating keys 139 for each of the four docking bays are different and correspond to the color of ink for that docking bay. The mating keys 139 are shaped to receive the corresponding keys 130 formed on a cap of an ink supply having the appropriate color. That is, the keys 130 and the mating keys 139 are shaped such that only an ink supply having the correct color of ink, as indicated by the keys on the cap, can be inserted into any particular docking bay. The mating keys 139 can also identify the type of ink supply that is to be installed in the docking bay. This system helps to prevent a user from inadvertently inserting an ink supply of one color into a docking bay for another color or from inserting an ink supply intended for one type of printer into the wrong type of printer.

When an ink supply in accordance with the present invention is empty, it can be easily refilled using the refill kit 200 illustrated in FIG. 12. The refill kit 200 includes a variable volume refill reservoir 202 which contains a quantity of ink. In the illustrated embodiment, the refill reservoir 202 has a bellows configuration. However in other embodiments the variable volume refill reservoir may have other shapes, such as a cylinder with a movable piston.

The refill kit 200 also includes a hollow needle 204 in fluid communication with the refill reservoir 202. In the illustrated refill kit, the hollow needle has a tapered end to allow it to more easily pierce the septum 54. However, the size and shape of the needle may vary in different embodiments, depending upon such factors as the size and type of septum, the amount and type of ink, or the material from which the needle is made. The illustrated hollow needle 202 and the refill reservoir are both formed of high density polyethylene. This facilitates manufacture of the unit and also results in a product that can be readily recycled after use. However, in other embodiments, it may be desirable to use other materials, such as stainless steel, to form the needle.

To use the refill kit 200, the hollow needle is inserted through the septum 54. This creates a fluid path from the refill reservoir 202 through the hollow needle 204 and into the ink reservoir 24. The variable volume refill reservoir 202 is then compressed to urge ink from the refill kit through the needle and into the ink supply. After the ink from the refill kit has been transferred into the ink supply, the needle can be withdrawn from the septum. The septum reseals to prevent ink from leaking from the reservoir and to limit the entry of air into the reservoir.

As can be appreciated, the illustrated method of refilling an ink supply is quick, easy, and clean. Moreover, it reduces the introduction of air or other contaminants into the ink supply so as to contribute to the reliable operation of the printer.

The illustrated refill kit can be used with a variety of ink supplies. For example, in the embodiment illustrated in FIG. 13, the fill plug is not used to refill the ink supply. Rather, the fill port 52 is plugged with a ball 54 that is press fit into the fill port after the ink supply is initially filled. A separate refill port 206 is formed in the ink supply to allow refilling. The refill port 206 includes an aperture formed through the top of the frame 46 that is plugged with a septum 208 made of a compliant material such as, polyisoprene rubber. An access aperture 210 is formed in the top of the shell 30 to allow access to the septurn.

The embodiment of FIG. 13 is refilled in much the same manner as previously described except that the needle 204 is inserted through the septurn 208 in the refill port 206 to establish a fluid path from the refill reservoir 202 to the ink reservoir 24.

In yet another embodiment, illustrated in FIG. 14, the fill port 52 of the ink supply is plugged with a ball 54, or other plug, press fit into place and the refill kit 200 includes a septum 208. In the illustrated embodiment, the septum is positioned about the needle. To use the refill kit, the needle 204 is used to press the ball 54 through the fill port. Further movement of the needle into the fill port causes the septum 208 to enter the and plug the fill port. The variable volume refill reservoir can then be compressed to transfer ink into the ink reservoir. Upon completion of the transfer process, the hollow needle is withdrawn, leaving the septum in place within the fill port.

This detailed description is set forth only for purposes of illustrating examples of the present invention and should not be considered to limit the scope thereof in any way. Clearly, numerous additions, and other modifications can be made to the invention without departing from the scope of the invention. For example, the present refill kit can be used to refill a wide variety of ink supplies in addition to the few embodiments described above. The scope of the present invention is defined in the appended claims and equivalents thereof.

What is claimed is:

1. A refill kit used to refill an ink reservoir of an ink-jet printer, the ink reservoir having a port with an internal diameter sized to allow introduction of ink into the ink reservoir, the port having a plug initially present within the port internal diameter which seals the port, the refill kit comprising:

a variable volume refill reservoir containing a quantity of ink;

a hollow needle having a first end and an opposing second end which define a needle length therebetween, the first end being connected to the refill reservoir, the opposing second end of the needle being appropriately shaped for receipt within the port, the needle length being appropriately sized for dislodging the plug present in the port internal diameter to establish a fluid pathway from the refill reservoir, through the needle, and into the ink reservoir, whereby insertion of the hollow needle within the port dislodges the plug and compression of the refill reservoir upon receipt of the needle opposing second end within the port causes the quantity of ink to flow through the fluid pathway into the ink reservoir; and a septum removably carried on an exterior surface between the first end and the second opposing end of hollow needle, the septum being of an appropriate diameter is received within the port as the hollow needle is inserted and is left within the port as the needle is withdrawn from the port.

2. A method of refilling an ink reservoir of an ink-jet printer, the ink reservoir having a port with an internal diameter sized to allow introduction of into the ink reservoir, the port having a plug initially present within the port internal diameter which forms a seal at the port, the method comprising the steps of:

providing a variable volume refill reservoir containing a quantity of ink;

providing a hollow needle having a first end and an opposing second end which define a needle length therebetween, the first end being connected to the refill reservoir, the opposing second end being appropriately shaped for receipt within the port;

inserting the needle into the port to push the plug into the ink reservoir and thus break the seal formed by the plug and create a fluid pathway from the refill reservoir to the ink reservoir;

compressing the refill reservoir to urge ink from the refill reservoir through the fluid pathway and into the ink reservoir;

providing a septum carried on the hollow needle between the first end and opposing second end thereof for resealing the port, positioning the septum within the port during the inserting step; and leaving the septum within the port as the needle is withdrawn from the port to thereby seal the port.

* * * * *

UNITED STATES PATENT AND TRADEMARK OFFICE

CERTIFICATE OF CORRECTION

PATENT NO. : 5,721,576
DATED : February 24, 1998
INVENTOR(S) : Barinaga

It is certified that error appears in the above-identified patent and that said Letters Patent is hereby corrected as shown below:

Column 14,
Line 33, after "of", insert -- ink --.

Signed and Sealed this

Seventh Day of October, 2003

JAMES E. ROGAN
*Director of the United States Patent and Trademark Office*